US010648193B2

(12) United States Patent
Ferrara

(10) Patent No.: US 10,648,193 B2
(45) Date of Patent: May 12, 2020

(54) SELF-ERECTING PORTABLE PROTECTIVE ENCLOSURE

(71) Applicant: Mark Ferrara, Stonington, CT (US)

(72) Inventor: Mark Ferrara, Stonington, CT (US)

( * ) Notice: Subject to any disclaimer, the term of this patent is extended or adjusted under 35 U.S.C. 154(b) by 0 days.

(21) Appl. No.: 16/430,698

(22) Filed: Jun. 4, 2019

(65) Prior Publication Data

US 2019/0284832 A1 Sep. 19, 2019

Related U.S. Application Data

(63) Continuation of application No. 15/829,180, filed on Dec. 1, 2017, now Pat. No. 10,323,435.

(60) Provisional application No. 62/431,082, filed on Dec. 7, 2016.

(51) Int. Cl.

| | |
|---|---|
| ***E04H 15/00*** | (2006.01) |
| ***E04H 15/58*** | (2006.01) |
| ***E04H 15/56*** | (2006.01) |
| ***E04H 15/64*** | (2006.01) |

(52) U.S. Cl.

CPC ..... *E04H 15/58* (2013.01); *E04H 15/001* (2013.01); *E04H 15/56* (2013.01); *E04H 15/64* (2013.01)

(58) Field of Classification Search

CPC ..... E04H 15/001; E04H 15/58

See application file for complete search history.

(56) References Cited

U.S. PATENT DOCUMENTS

| | | | | |
|---|---|---|---|---|
| 2,159,273 A | | 5/1939 | Killinger | |
| 2,485,914 A | | 10/1949 | Owens | |
| D237,964 S | | 12/1975 | Choponis | |
| 3,990,463 A | | 11/1976 | Norman | |
| 4,067,346 A | * | 1/1978 | Husted | E04H 15/001 135/153 |
| D250,687 S | | 1/1979 | Robelen | |
| 4,582,062 A | | 4/1986 | Albini | |
| D285,880 S | | 9/1986 | Griesenbeck | |

(Continued)

FOREIGN PATENT DOCUMENTS

JP 2015212797 A 11/2015

OTHER PUBLICATIONS

EP Search Report and Opinion of EP17205258.1, which is in the same family as U.S. Appl. No. 15/829,180, dated Aug. 31, 2018, 10 pgs.

(Continued)

*Primary Examiner* — Noah Chandler Hawk
(74) *Attorney, Agent, or Firm* — Moyles IP, LLC

(57) ABSTRACT

A portable protective enclosure and a method of using the enclosure is presented. The enclosure may include a plurality of walls extending around and at least partially defining an interior space for being occupied by a user, and a top panel overlying and at least partially defining the space. The plurality of walls may include an entry wall and side walls. The entry wall may include a door flap moveable between open and closed positions. The side wall may include a window having a see-through material, and a window flap in a facing relationship with the window and moveable between open and closed positions. The enclosure may include a floor panel detachably joined to at least one of the walls by a fastener that is accessible from within the interior space, so that the floor panel is detachable from the walls from within the interior space.

20 Claims, 15 Drawing Sheets

(56) References Cited

U.S. PATENT DOCUMENTS

| | | | |
|---|---|---|---|
| 4,719,935 | A | 1/1988 | Gustafson |
| 4,938,243 | A | 7/1990 | Foster |
| D313,830 | S | 1/1991 | Foust |
| 5,080,119 | A | 1/1992 | Scherer |
| D326,495 | S | 5/1992 | Pearce |
| D366,305 | S | 1/1996 | Roehler |
| D366,511 | S | 1/1996 | Coddington, Jr. |
| D381,058 | S | 7/1997 | Lowenthal |
| D383,188 | S | 9/1997 | Bohart |
| 5,921,043 | A | 7/1999 | McDonald |
| D412,959 | S | 8/1999 | Cung |
| D421,285 | S | 2/2000 | Murphy |
| D425,958 | S | 5/2000 | DePasquale |
| 6,071,174 | A | 6/2000 | Yoon |
| 6,092,544 | A | 7/2000 | Zheng |
| D429,307 | S | 8/2000 | Wu et al. |
| D449,447 | S | 10/2001 | Kellogg et al. |
| 6,305,396 | B1 | 10/2001 | Zheng |
| 6,318,394 | B1 | 11/2001 | Zheng |
| 6,397,870 | B1 | 6/2002 | Makedonsky et al. |
| 6,453,923 | B2 | 9/2002 | Zheng |
| 6,585,414 | B2 | 7/2003 | Peska |
| 6,701,948 | B2 | 3/2004 | Jopp et al. |
| 6,715,446 | B2 | 4/2004 | Chou |
| 6,851,439 | B2 | 2/2005 | Zheng |
| D504,519 | S | 4/2005 | Wehner |
| D510,972 | S | 10/2005 | Wehner |
| D511,196 | S | 11/2005 | Wehner |
| D514,747 | S | 2/2006 | Bertoli et al. |
| 7,040,333 | B1 | 5/2006 | Ransom et al. |
| 7,137,399 | B1 | 11/2006 | Ransom et al. |
| 7,178,538 | B2 | 2/2007 | Ransom |
| 7,201,177 | B2 | 4/2007 | Anticoli et al. |
| D559,140 | S | 1/2008 | Hilton |
| 7,320,332 | B2 | 1/2008 | Reis |
| 7,418,919 | B2 | 9/2008 | Smith et al. |
| 7,481,234 | B1 | 1/2009 | Gustafson et al. |
| 7,484,520 | B2 | 2/2009 | Zheng |
| 7,523,719 | B2 | 4/2009 | Miller et al. |
| 7,552,739 | B2 | 6/2009 | Chu et al. |
| 7,565,909 | B2 | 7/2009 | Reis et al. |
| D610,217 | S | 2/2010 | Krueger |
| D617,838 | S | 6/2010 | Jedlicka |
| D617,841 | S | 6/2010 | Jedlicka |
| 7,775,230 | B2 | 8/2010 | Lau |
| 7,789,044 | B2 | 9/2010 | McGrade |
| D634,932 | S | 3/2011 | Sabounjian |
| 8,474,215 | B2 | 7/2013 | DeRose |
| D691,688 | S | 10/2013 | Pescovitz |
| D691,689 | S | 10/2013 | Pescovitz |
| D691,690 | S | 10/2013 | Pescovitz |
| D711,996 | S | 8/2014 | Pescovitz |
| D711,997 | S | 8/2014 | Pescovitz |
| D711,998 | S | 8/2014 | Pescovitz |
| 8,869,814 | B2 | 10/2014 | Jin |
| 8,943,758 | B2 | 2/2015 | Miller |
| D725,735 | S | 3/2015 | Pescovitz |
| D735,885 | S | 8/2015 | Wehner |
| 9,485,957 | B2 | 11/2016 | Kellogg |
| D776,777 | S | 1/2017 | Pescovitz |
| D776,778 | S | 1/2017 | Pescovitz |
| D776,779 | S | 1/2017 | Pescovitz |
| D790,023 | S | 6/2017 | Pescovitz |
| D790,024 | S | 6/2017 | Pescovitz |
| D790,025 | S | 6/2017 | Pescovitz |
| D790,026 | S | 6/2017 | Pescovitz |
| D812,248 | S | 3/2018 | Leckrone et al. |
| D814,590 | S | 4/2018 | Pescovitz |
| 2002/0069904 | A1 | 6/2002 | Robinson |
| 2002/0179133 | A1 | 12/2002 | Abbinante |
| 2004/0159347 | A1 | 8/2004 | Brown et al. |
| 2004/0255526 | A1 | 12/2004 | Tremblay |
| 2005/0081903 | A1 | 4/2005 | Wang |
| 2005/0189010 | A1 | 9/2005 | Sumner |
| 2006/0138911 | A1 | 6/2006 | Ransom |
| 2006/0169309 | A1* | 8/2006 | Brackins ..... E04H 15/001 135/119 |
| 2006/0169310 | A1 | 8/2006 | Qian et al. |
| 2007/0039640 | A1 | 2/2007 | Zheng |
| 2007/0074462 | A1 | 4/2007 | Linares |
| 2007/0193614 | A1 | 8/2007 | Egstad |
| 2009/0044446 | A1 | 2/2009 | Kellogg et al. |
| 2009/0151242 | A1 | 6/2009 | Kellogg et al. |
| 2011/0168221 | A1 | 7/2011 | Schlipf |
| 2011/0174811 | A1 | 7/2011 | Sabounjian |
| 2012/0167934 | A1 | 7/2012 | Rothweil |
| 2013/0061897 | A1 | 3/2013 | Webster et al. |
| 2013/0074894 | A1 | 3/2013 | Cook |
| 2013/0306121 | A1 | 11/2013 | Hung Lau |

OTHER PUBLICATIONS

Tampabay Tan, The Original Instant Pop Up Airbrush Tanning Room, Jun. 3, 2010, 7 pgs, https://web.archive.org/web/20100603080324/http://www.tampabaytan.com:80/Scripts/prodView.

The Tanning Store, Black Pearl Tiki Tent Pop-Up Changing Room & Tanning Tent, Mar. 5, 2009, 2 pgs, https://web.archive.org/web/20090300501110/http://www.thetanningstore.com/.

AMAZON.COM, Instant Pop-Up Airbrush Tanning Tent Booth, Jan. 31, 2010, 1pg, https://web.archive.org/web/20100131155522/http://www.amazon.com/Instant-Pop-Up.

AMAZON.COM, Privacy Pop Up Portable Tent—Green, Jul. 24, 2010,1 pg, https://web.archive.org/web/20100724154037/http://www.amazon.com/Privacy-Pop-Up-Portable-Tent.

Camping World, Moraine Park 4 Person Fast Pitch Dome Tent with Shelf, Jul. 20, 2015, 3 pgs, https://web.archive.org/web/20150720113210/http://www.campingworld.com/shopping/item.

Garden Tools by Lee Valley, Insect-a-Hide Pop-Up Shelter, Product Catalog, 2014 Season, p. 159, 3 pgs.

AMAZON.COM, Wolfwise Instant Pop-Up, Jul. 5, 2017, 8 pgs, https://web.archive.org/web/20170705181326/https://www.wolfwise.com/collections/outdoor-tent/.

Academy, Magellan Outdoors Portable Utility Tent, 2 pgs, 2015, http://www.academy.com/shop/pdp/magellan-outdoors-portable-1-person-utility-tent.

Wayfair, Privacy Shelter Hilo Hut, 3 pgs, Mar. 2015, https://www.wayfair.com/Texsport-Privacy-Shelter-Hilo-Hut-TEQ1112.html.

AMAZON.COM, Professional Airbrush and Turbine Tanning Tent Booth, 5 pgs, Jun. 13, 2011, https://www.amazon.com/Professional-Airbrush-Carrying-Solution-Solutions/dp/B003Z3C3K4/.

* cited by examiner

SELF-ERECTING PORTABLE PROTECTIVE ENCLOSURE

CROSS-REFERENCE TO RELATED APPLICATIONS

This application is a continuation of U.S. application Ser. No. 15/829,180 filed Dec. 1, 2017, claims the benefit of U.S. Provisional Patent Application No. 62/431,082 filed Dec. 7, 2016, which is incorporated herein by reference in its entirety.

FIELD

A portable protective enclosure is generally described. In particular, a portable personal enclosure for providing protection against weather elements, bugs and/or insects, while facilitating a user's privacy is provided.

BACKGROUND

Known techniques and devices for providing protection against weather elements, such as rain, snow, hail and sleet, include shelter structures, such as, tents and other canopy structures. These structures are often used outdoors, for activities that may include camping. Because these tents are used in the outdoors and may be exposed to the weather elements, including wind, they often need to be secured to the ground, by stakes or other strong and substantial securing means.

In addition, use of these tent structures may vary from requiring portable shelters that can be moved from one place to another to larger tent structures that may include rigid supports that help keep the structure at a single location for an extended amount of time. While the portable shelters may offer a user with flexibility of where the shelter can be used, this flexibility may be limited when the user will be at locations experiencing, for example, heavy winds and/or rain. While larger and more rigid tent structures may be able to withstand heavy winds and/or rain, they are not portable by the user.

Tent structures are also often used in activities that may require privacy, such as sleeping and changing clothing. These structures usually include fabric sheets or other cloth-like material that are mounted on and/or secured to poles. Coupled with the desire to provide protection against the weather elements, these structures may be substantially waterproof and/or leak-proof in an effort to keep users dry. An issue with these structures is that while they may prevent water from entering the structure, they do not allow for the admittance of air therethrough, which may limit the user's ability to received required ventilation. In addition, should the user need to move the structure to, for example, a drier location, the user will have to exit the structure in order to do so, which may expose the user to undesirable weather elements and/or insects and/or bugs that are outside the structure. A user's exposure to insects, such as mosquitos, can cause potentially serious health risks. For instance, users may be exposed to an *Aedes* species mosquitos infected with the Zika virus—a virus for which no vaccine and/or medicinal treatment are presently available. If users are bitten by an infected *Aedes* species mosquito, the user may experience fever, rash, joint pain, conjunctivitis, headache and/or muscle pain. A pregnant user may pass the Zika virus to her unborn fetus. Thus, limiting exposure to insects that may be infected with serious In view of the disadvantages associated with currently available methods and devices for protection against weather elements, there is a need for a device and method that provides full body protection against weather elements, while also providing adequate ventilation for a user. There is also a need for a protective enclosure that inhibits the admittance of bugs and/or insects within the enclosure, while also providing all-around water resistance and ventilation for the user, and being versatile enough to be moved from one location to another without requiring the user to exit the device. In addition, there is a need for a protective enclosure that is easily transportable, without requiring assembly of multiple components and tools to secure the device to various outdoor groundcover surfaces, such as grass, dirt, sand, concrete, stone, synthetic (e.g. rubber) or natural mulch, wood chips, engineered wood fiber, pavers, poured rubber, rubber tiles, wood decking, pea gravel, synthetic turf, and the like.

BRIEF DESCRIPTION

According to an aspect, the present embodiments may be associated with a portable protective enclosure. The portable protective enclosure may include a plurality of walls extending around and at least partially defining an interior space for being occupied by a user. The plurality of walls may include an entry wall including a door flap. According to an aspect, the door flap is movable between an open position and a closed position. The portable protective enclosure may include a side wall. According to an aspect, the side wall may include a window having a see-through material, and a window flap in a facing relationship with the window. The window flap may be movable between an open position and a closed position. According to an aspect, the portable protective enclosure further includes a top panel overlying and at least partially defining the interior space, and a floor panel including a floor flap. The floor flap may be detachably joined to the floor panel by a fastener. In an embodiment, the fastener is accessible from within the interior space, so that the floor flap can be at least partially detached from the floor panel from within the interior space. The side walls, the entry wall, the top panel and the floor panel together define the interior space of the portable protective enclosure.

According to an aspect, the present embodiments may be associated with a portable protective enclosure that includes a plurality of walls that at least partially define an interior space. The plurality of walls may include an entry wall including a detachably fastened door flap that is movable between an open position and a closed position. According to an aspect, the plurality of walls further include a side wall having a window that include a see-through material, and a window flap for at least temporarily covering the window. The portable protective enclosure may include a canopy overlying the interior space, and a floor panel including a floor flap that is detachably attached to the floor panel. The floor flap may be detachably attached to the floor panel by a fastener accessible by a user positioned within the interior space, such that the floor flap may be detached from the floor panel from within the interior space. According to an aspect, a pair of handles is joined to an interior side of a respective pair of the plurality of walls. The handles may be configured for moving the enclosure from a first location to a second location, from within the interior space. More specifically, the present embodiments relate to a method of using the portable protective enclosure. According to an aspect, the method includes, from within the interior space, detaching the floor flap from the floor panel, grasping the pair of handles, lifting the portable protective enclosure, and moving the portable protective enclosure to a desired location.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
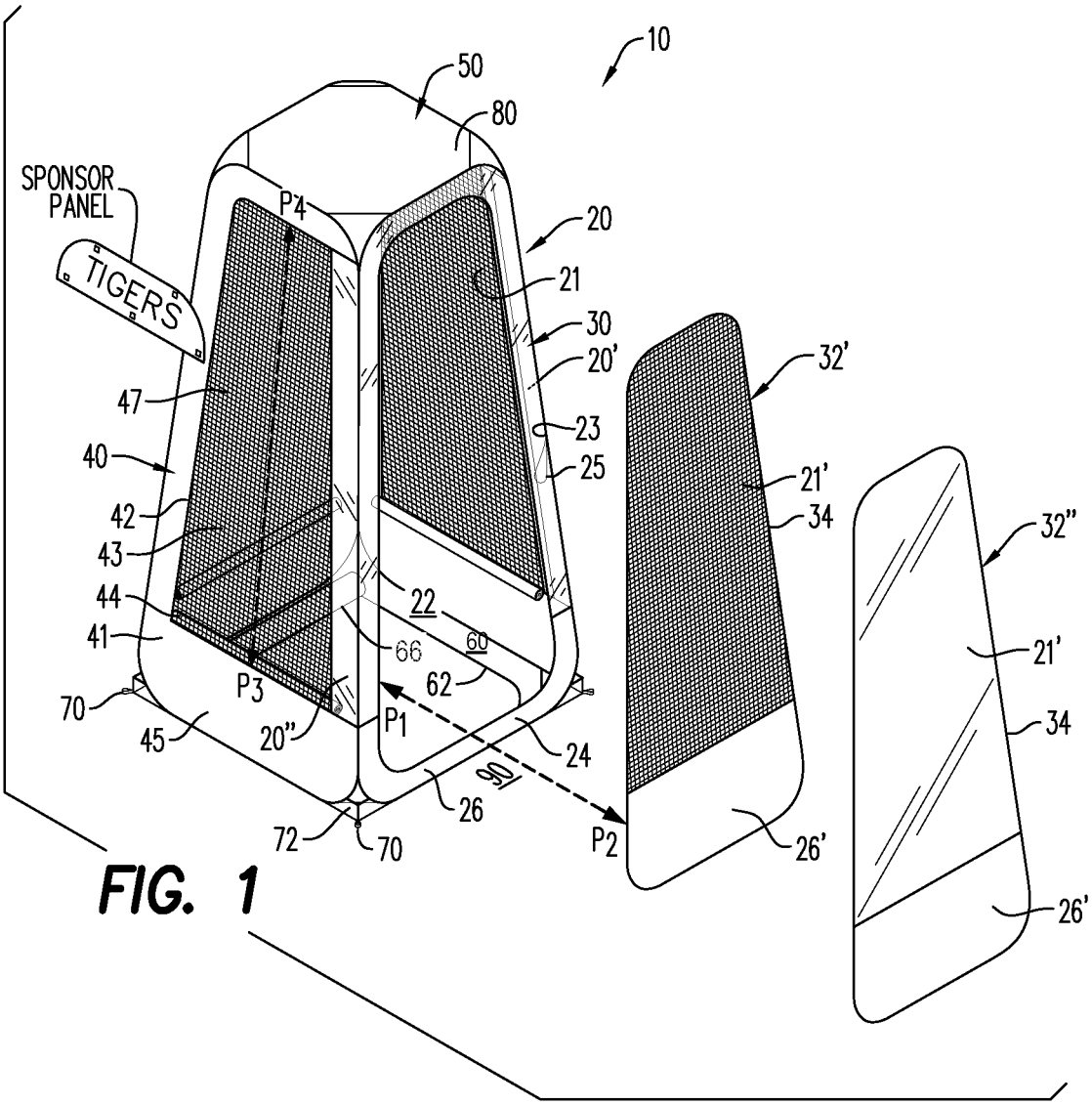
FIG. 1 is an exploded view of a portable protective enclosure, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

The term "protective enclosure" may mean a structure that is capable of providing protection against at least one of weather elements, insects and/or bugs.

As used herein, the term "see-through" may mean a substantially transparent material or a material that has some degree of transparency that may allow a user to see objects that are separated by the substantially transparent material. For example, a see-through material may be a mesh-like material that provides limited obstruction to a user's view and/or a material that is lucid and provides no obstruction to a user's view, such as, for example, acrylic and polycarbonate sheets of film.

As used herein, the term "non-see-through" may mean a substantially opaque material that substantially inhibits the transmittance of light therethrough, such that it obscures a user's view through said material. For example, a non-see-through material may include canvas, nylon, polyester, polycotton, and the like.

As used herein, the term "solid material" may mean a material, such as fabric, that has high density or denier. Such solid material may include polymers and/or various plastics, such as for example nylon.

As used herein, the term "waterproof material" may mean a material that is capable of inhibiting/or sustaining water placed on a surface of the material for some time, before the water/liquid leaks through the other side of the material.

As used herein, the term "water resistant" may mean the ability of a material to cause water to bead on its surface, thus resisting saturation of the material.

Embodiments of the disclosure relate generally to devices and methods for providing protection against the weather elements, bugs and/or insects. Such devices find particular utility in providing protection against weather elements, such as, rain, snow, sleet, hail, wind, sun, etc., as well as against bugs and/or insects, such as mosquitos, flies, ticks, etc. According to an aspect, the devices contemplated may include a plurality of walls that extend around and at least partially define an interior space to be occupied by a user. The plurality of walls may include an entry wall including a door flap. According to an aspect, the door flap is movable between an open position and a closed position, such that the user may enter and/or exit the interior space when desired, and when the user is within the interior space and the door flap is in the closed position, the user receives protection from the weather elements, bugs and/or insects external to the enclosure. The plurality of walls may further include a side wall that includes a window and a window flap. In an embodiment, the window includes a see-through material, and the window flap is in a facing relationship with the window. The window flap may be movable between an open position and a closed position, thus being able to provide protection against the weather elements, bugs and/or insects, and provide ventilation to the user. The portable protective enclosure may include a top panel that overlies and at least partially defines the interior space, and a floor panel. The floor panel includes a floor flap detachably joined/connected to the floor panel by a fastener. According to an aspect, the fastener is accessible from within the interior space, so that the floor flap can be at least partially detached from the at least one of the plurality of walls from within the interior space.

Further, embodiments contemplated herein relate to a portable protective enclosure that is moveable by a user while the user is within an interior space of the protective enclosure. The portable protective enclosure includes a plurality of walls that at least partially define an interior space, a canopy that defines the interior space, a floor panel having a floor flap that is detachably attached to the floor panel, and a pair of handles joined to an interior side of a respective pair of the plurality of walls. According to an aspect, the floor flap is configured for being detached from the floor panel from within the interior space, and the handles are for moving the enclosure from a first location to a second location from within the interior space. Embodiments of the disclosure may further relate to a method of using the portable protective device. According to a method, the method includes detaching the floor flap from the at least one wall of the plurality of walls, grasping the pair of handles, lifting the portable protective enclosure, and moving the portable protective enclosure to a desired location.

For purposes of illustrating features of the embodiments, examples will now be introduced and referenced throughout the disclosure. Those skilled in the art will recognize that these examples are illustrative and not limiting and are provided purely for explanatory purposes.

Figure 2:
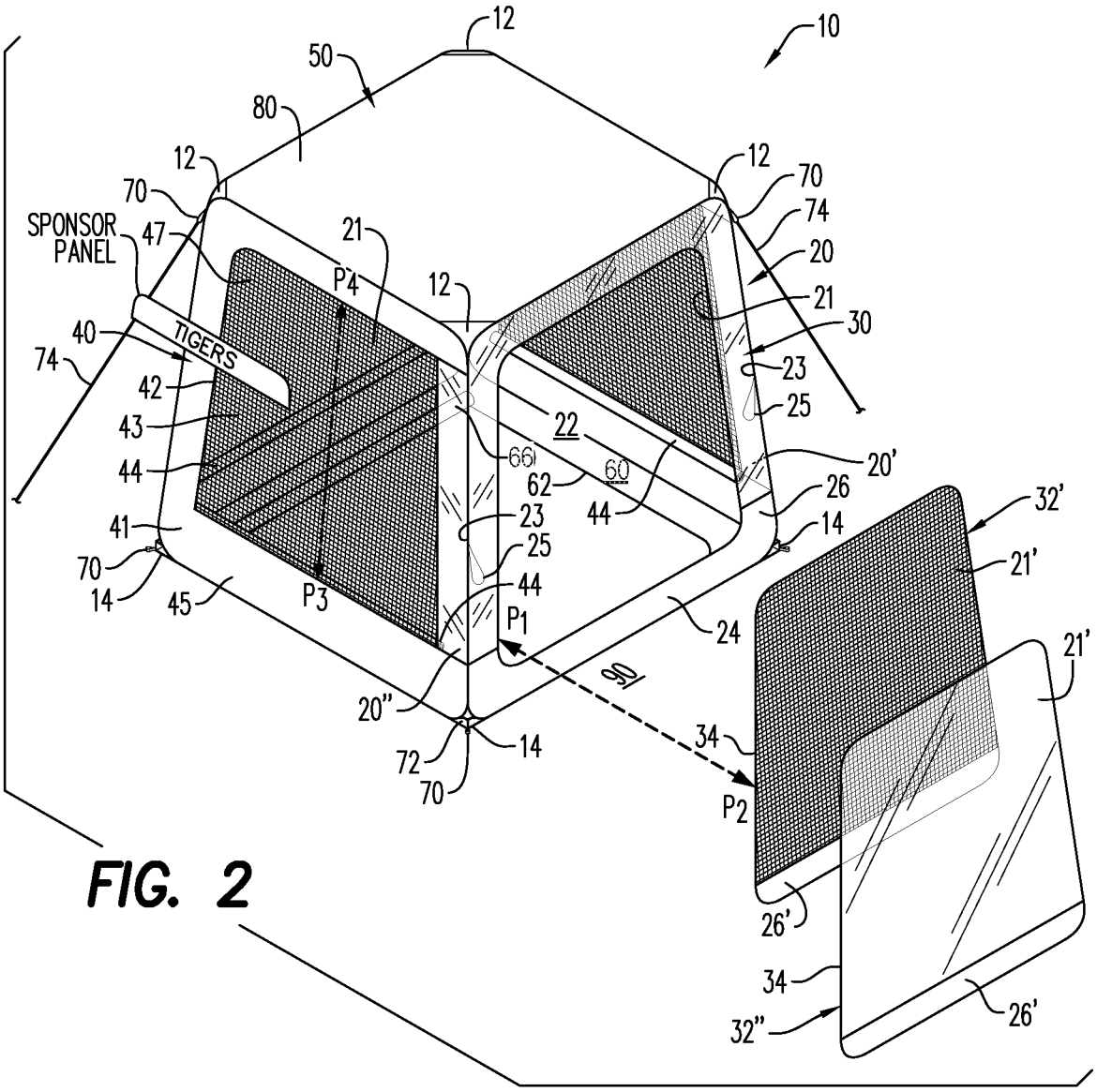
FIG. 2 is an exploded view of a portable protective enclosure, according to an embodiment.
Figure 3A:
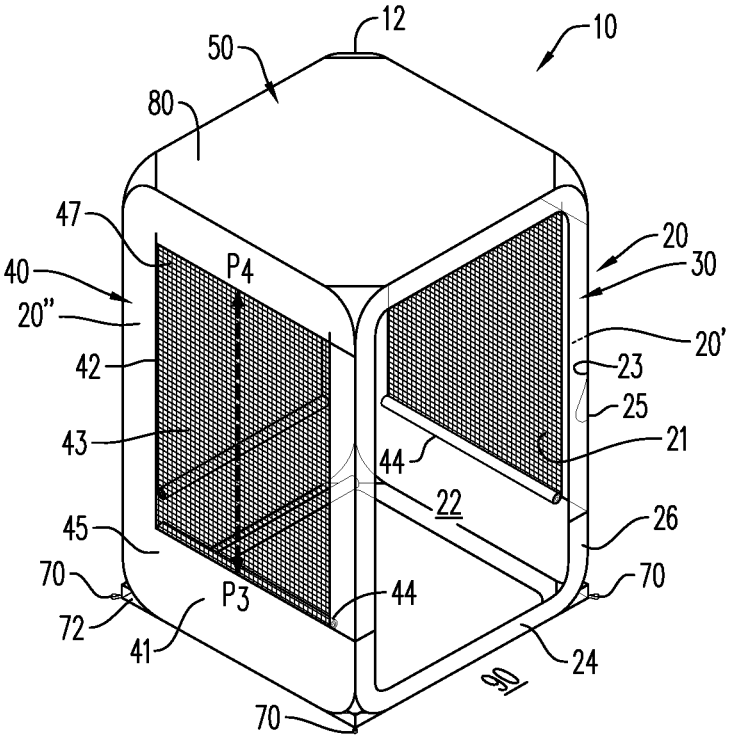
FIG. 3A is a perspective view of a portable protective enclosure, illustrating detachably fastened door flaps detached from the entry wall, according to an embodiment.

In an embodiment, and with particular reference to the figures, a portable protective enclosure 10 is illustrated. FIGS. 1, 2 and 3A illustrate the portable protective enclosure 10 including a plurality of walls 20 that extend around and at least partially define an interior space 22 for being occupied by a user. The portable protective enclosure 10 may further include a top panel 50 that overlies the interior space 22 and a floor panel 60 that underlies the interior space 22.

According to an aspect, and as illustrated in FIGS. 1-2 and 3A, the plurality of walls 20 each include a non-see-through wall portion 24 that extends along and defines a lower portion 26 of the plurality of walls 20. Each of the non-see-through wall portions 24 may inhibit or substantially limit the view of the interior space 22 of the enclosure 10 by anyone located outside the interior space 22, thus providing privacy for the user of the protective enclosure 10. In an embodiment, the plurality of walls 20 each include an upper portion 21 positioned between the lower portion 26 of the respective wall 20 and the top panel 50. Then non-see-through wall portion/privacy panel 24 may be configured to hide items within the interior space 22 form the view of any persons outside the portable protective enclosure 10. At least a part of the upper portion 21 may include the non-see-through wall portion 24. According to an aspect, the plurality of walls 20 includes an entry wall 30 and a side wall 40. Each of the entry wall 30 and the side wall 40 may include the lower portion 26 and the upper portion 21, thus the entry and side walls 30, 40 may include a part of the non-see-through wall portions 24.

According to an aspect, the embodiments may be associated with a portable protective enclosure 10 that includes a detachably fastened door flap 32. In an embodiment, the portable protective enclosure 10 includes a plurality of walls 20 that at least partially define an interior space 22. The plurality of walls 20 may include an entry wall 30 including the detachably fastened door flap 32 that is movable between an open position P1 and a closed position P2, as seen for instance in FIGS. 1-2 and 3A. The plurality of walls 20 may further include a side wall 40 having a window 42 that includes a see-through material 43, substantially as described hereinabove. The window 42 may also include a window flap 44 that at least temporarily covers the window 42. According to an aspect, the enclosure 10 includes a canopy 80 overlying the interior space 22, and a floor panel 60. The floor panel 60 includes a detachably attached floor flap 66. According to an aspect, the floor flap 66 is attached/secured to the floor panel 60 by a fastener 62 that is accessible by a user positioned within the interior space 22. The enclosure 10 may further include a pair of handles 25 joined to an interior side 23 of a respective pair 20', 20" of the plurality of walls 20. According to an aspect, the floor flap 66 is configured for being detached from the walls 20 from within the interior space 22, and the handles 25 are for moving the enclosure 10 from a first location to a second, third, fourth location, etc. from within the interior space 22.

Figure 4A:
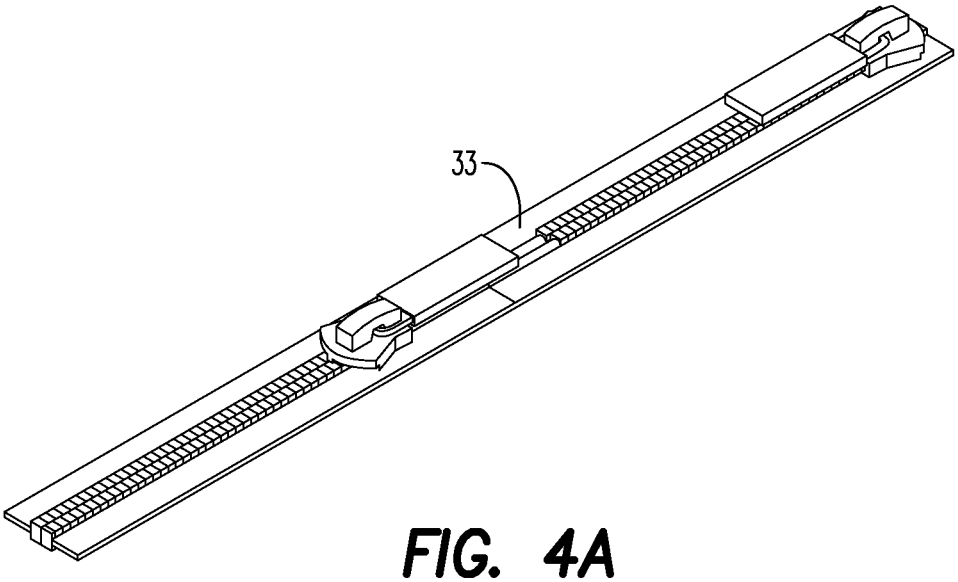
FIGS. 4A-4B are perspective views a connector of the detachably fastened door flaps of a portable protective enclosure, according to an embodiment.
Figure 4B:
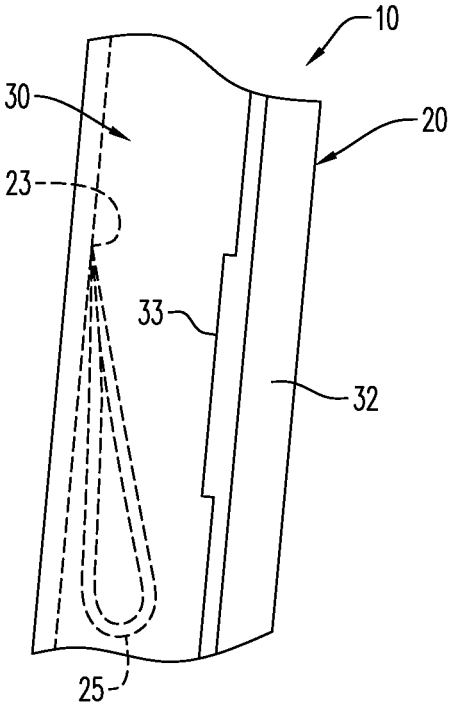
Figure 5A:
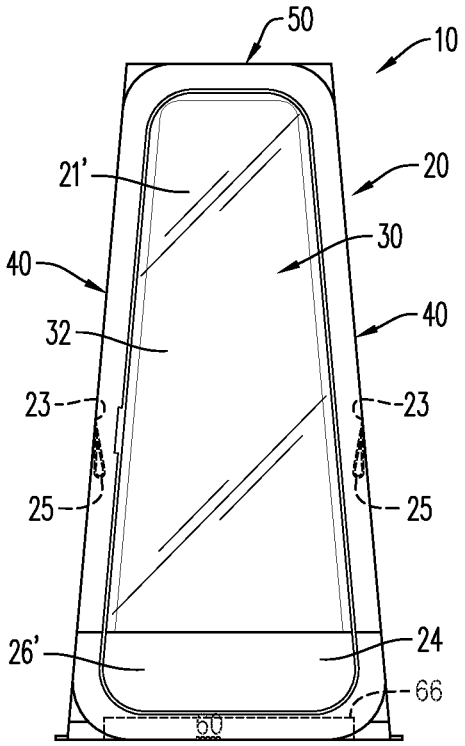
FIG. 5A is a front view of the portable protective enclosure of FIG. 1.
Figure 5B:
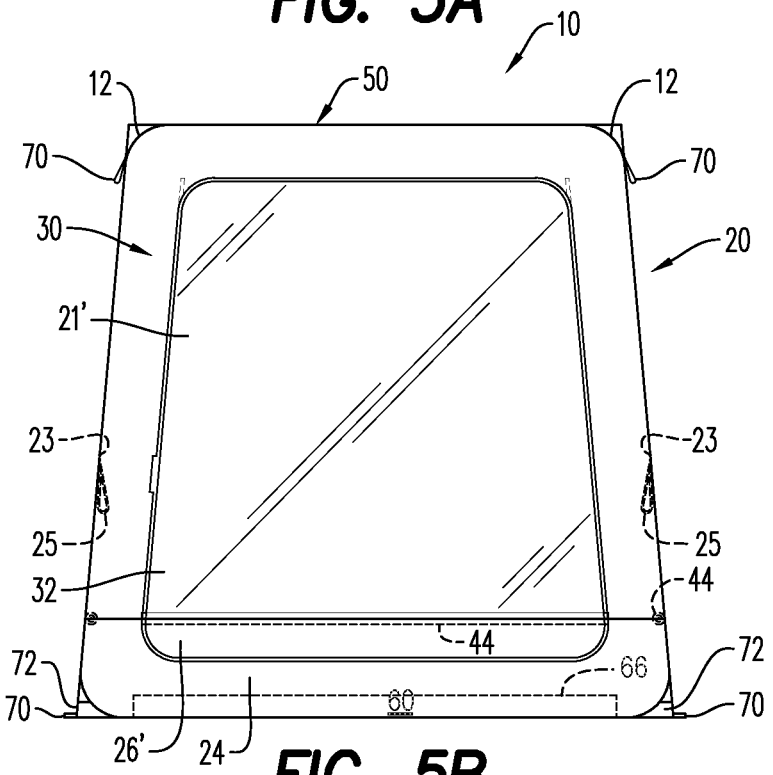
FIG. 5B is a front view of the portable protective enclosure of FIG. 2.
Figure 5C:
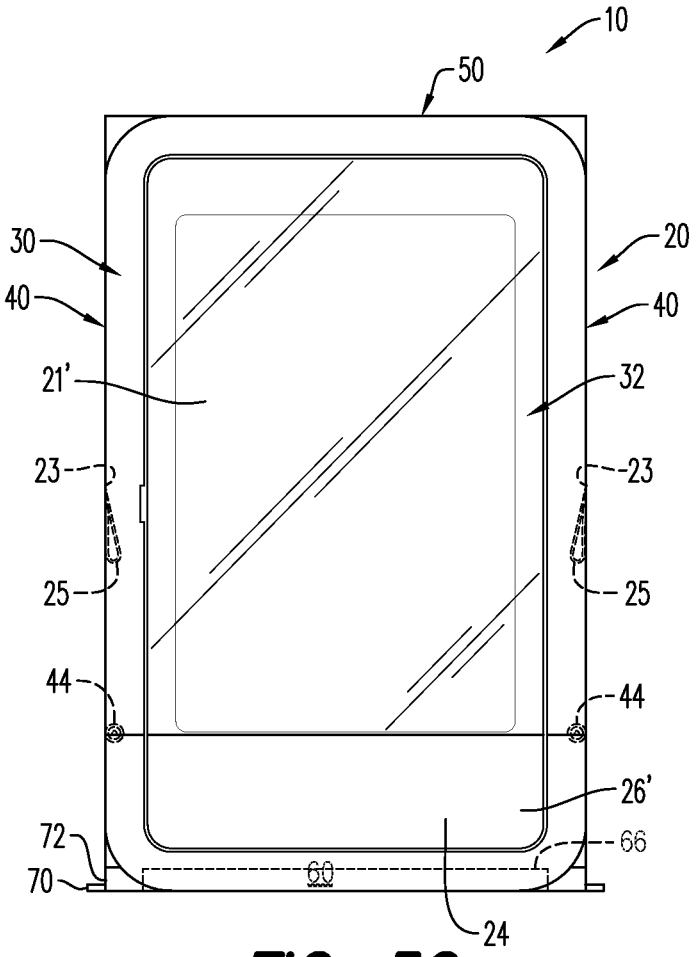
FIG. 5C is a front view of the portable protective enclosure of FIG. 3.

Now referring to FIGS. 5A-5C, the entry wall 30 is shown as having a door flap 32. As seen for instance in FIGS. 1-2, 3A, 3B and 5A-5C, the door flap 32 may include at least a portion of each of the upper portion 21' and the lower portion 26'. According to an aspect and as illustrated in FIGS. 1-2 and 3*a*, the door flap 32 is movable between an open position P1 and a closed position P2. The door flap 32 may include a peripheral edge 34 that is at least partially/temporarily secured to the entry wall 30. At least a portion of the door flap 32 may be secured to the entry wall via a connector 33. As seen, for instance in FIG. 4A, the connector 33 may be a zipper. To be sure, the connector 33 may be any device that is capable of releasably securing and/or connecting the door flap 32 to the entry wall 30. According to an aspect and as seen for instance in FIG. 4B, a material used to form the plurality of walls 20 may cover the connector 33. The material may be in a covering relationship with the connector 33 to protect the connector 33 against damage, weather, and wear and tear.

Figure 3B:
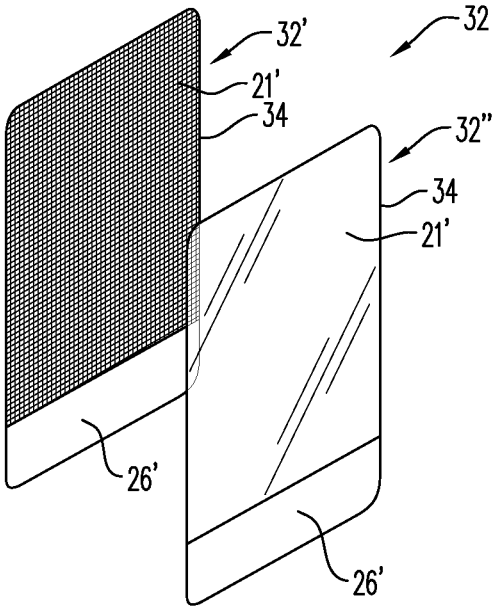
FIG. 3B is a perspective view of the detached door flaps of FIG. 3A.

In embodiment, and as illustrated in FIGS. 1-2 and 3B, the door flap 32 is fully removable from the entry wall 30. In other words, the open position P1 of the door flap may be such that the peripheral edge 34 of the door flap 32 is no longer in an engagement relationship with the entry wall 30. According to an aspect, the door flap 32 may include 2, 3, or more door flaps 32 that are in a layering relationship with each other. As illustrated in FIG. 3B and in an embodiment, the door flap 32 is a first door flap 32', and a second door flap 32" is provided in a layered relationship with the first door flap 32'. According to an aspect, the first door flap 32' may include a mesh material that allows the transmittance of light and/or air therethrough. Thus, in instances where the first door flap 32' is in its closed position P2, and when the second door flap 32 is not in a facing relationship with the first door flap 32', the first door flap 32' may still allow light and/or air to enter and/or exit the interior space 22 of the portable protective enclosure 10. Alternatively, when the door flap 32 is closed and/or when both the first door flap 32' and the second door flap 32" is in a layering relationship and the peripheral edge 34 is completely affixed to the entry wall 30, light may be admitted therethrough while air, water and/or snow may be kept out of the interior space 22. This may be particularly helpful in circumstances where a user seeks to prevent the admittance of weather elements within the interior space of the enclosure 10. While two door flaps 32', 32" have been referenced herein, to be sure, the number of door flaps 32 provided may be 1, 3, 4, 5, which may be selected based on the needs of the particular application in which the enclosure 10 is being used.

In an embodiment, the entry wall 30 includes one or more viewing windows. Each viewing window may include a first edge and a second edge (not shown). According to an aspect, the first edge of the viewing windows is affixed to the door flap 32', 32". The first edge may be affixed to or may extend from the door flap 32. In an embodiment, the second edge is configured to be vertically moveable and/or sealable from a closed position to an open position. According to an aspect, the second edge may include a sealing and/or closing mechanism, such as, for example, magnets, clips, snaps, Velcro®, and the like. The sealing mechanism may include a single-handed closure mechanism that allows the viewing windows to easily open and/or close. It would be understood by one of ordinary skill in the art that the second edge could be fixed and the first edge could be moveable to a closed/open position. The viewing windows may be arranged at any position on the door flap 32 of the entry wall 30. According to an aspect, the viewing windows may be positioned at the upper portion 21' of the entry wall, such that when the enclosure 10 is in use, the viewing window may be substantially located at or near the user's eye level. According to an aspect, two or more viewing windows are arranged in the door flap 32', 32", such that the viewing windows may be used when the user sits and/or stands in the enclosure 10. When the viewing windows provided are two or more, the viewing windows may be vertically and/or horizontally arranged, with respect to each other. In an embodiment, each of the viewing windows provides a substantially waterproof seal when closed. Thus, the viewing window may be adapted for at least one of observation and admittance of light and air therethrough.

Figure 10A:
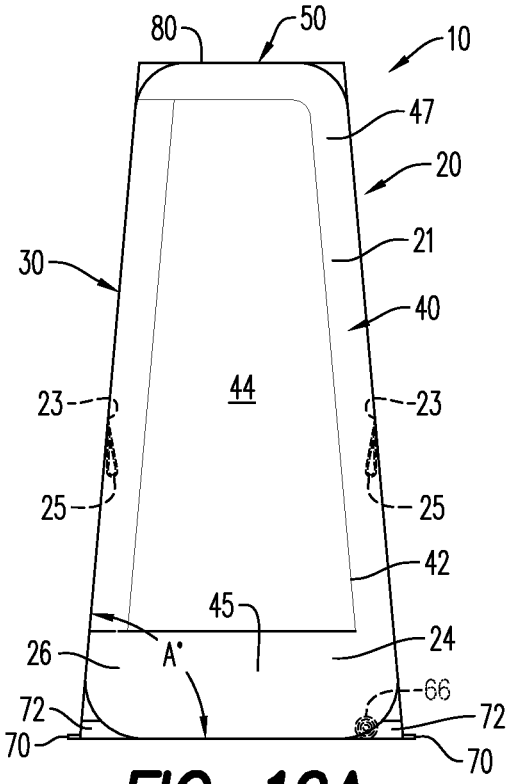
FIG. 10A is a side view of the portable protective enclosure of FIG. 1, illustrating a side wall, a retractable floor and window in a closed position, according to an embodiment.
Figure 10B:
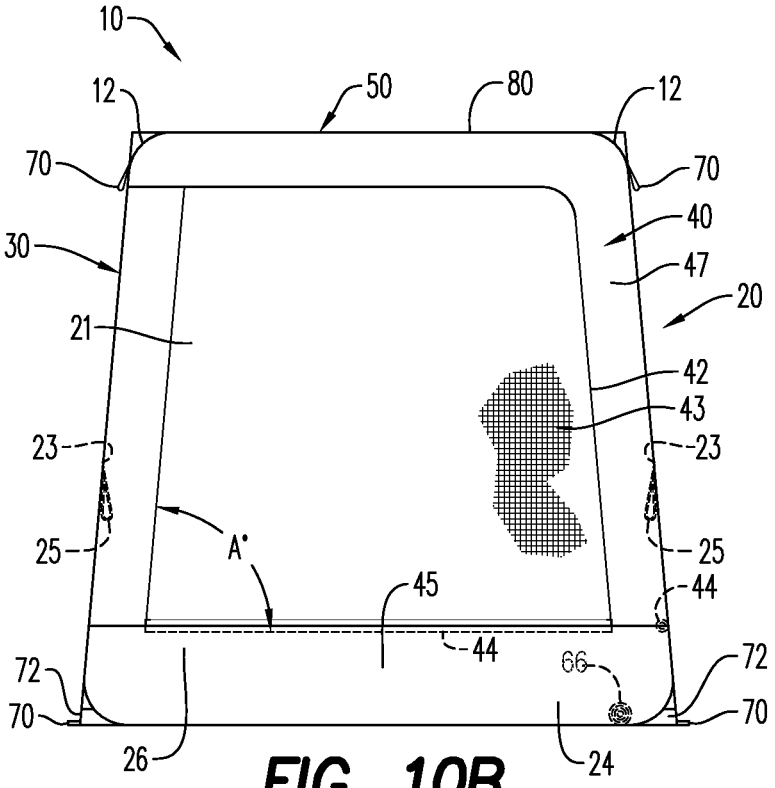
FIG. 10B is a side view of the portable protective enclosure of FIG. 2, illustrating a side wall, a retractable floor and a window in an open position, according to an embodiment.
Figure 10C:
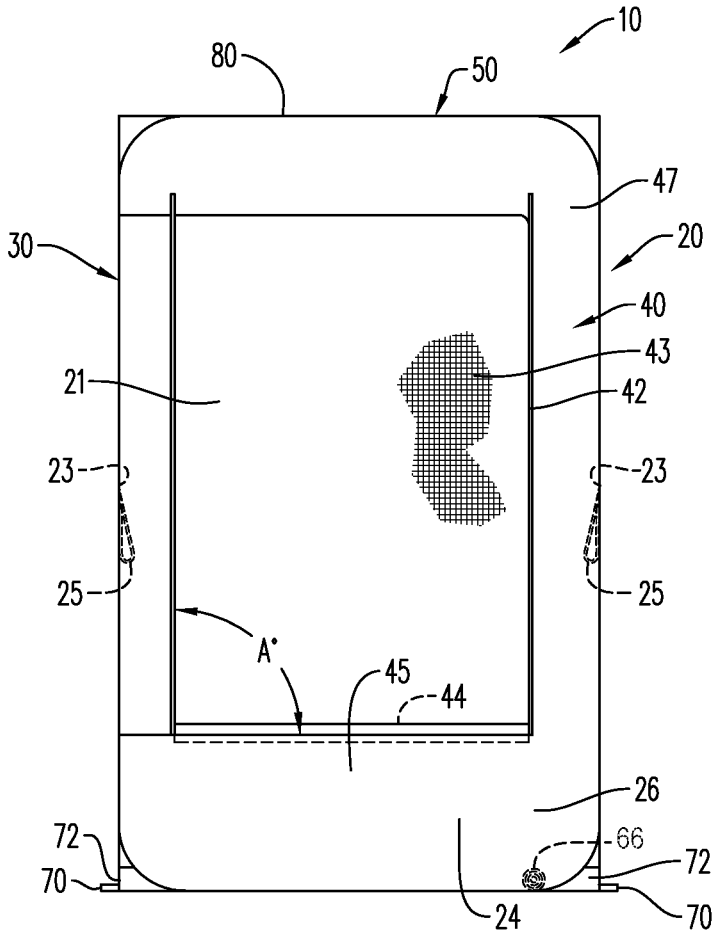
FIG. 10C is a side view of the portable protective enclosure of FIG. 3, illustrating a side wall, a retractable floor and a window in an open position, according to an embodiment.
Figure 11A:
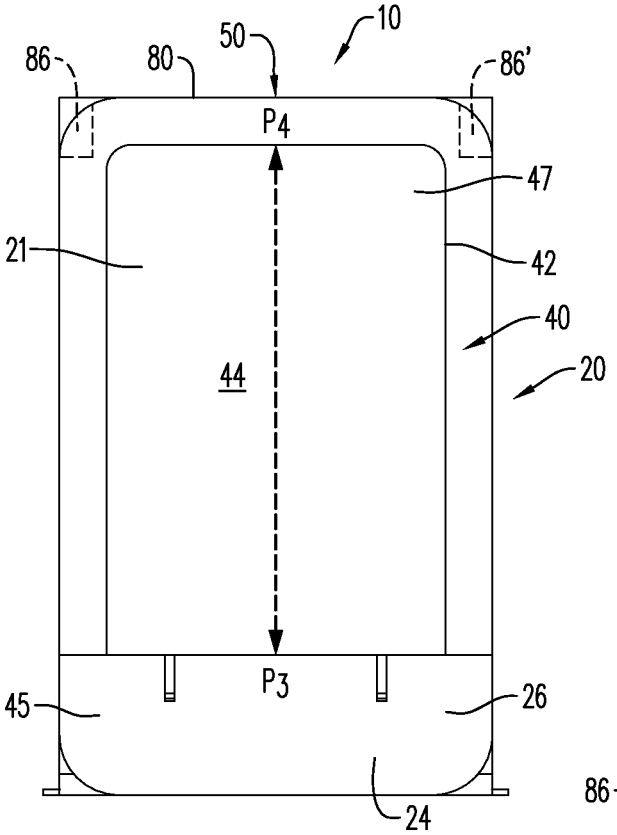
FIGS. 11A and 11B are side view of a portable protective enclosure, illustrating the window in a closed position and in an open position, respectively, according to an embodiment.
Figure 11B:
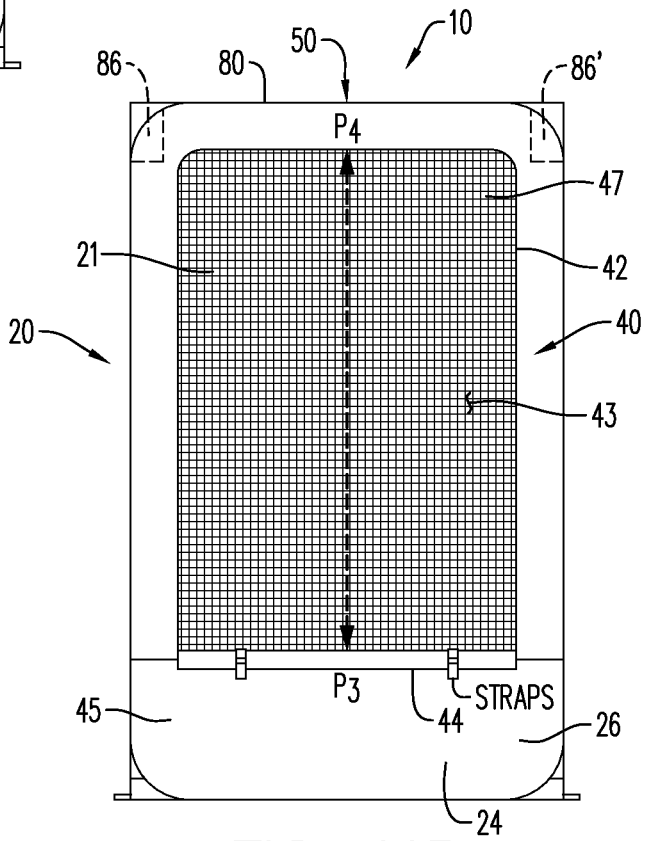

FIGS. 10A-10C and 11A-11B illustrate the sidewalls 40 of the enclosure 10, according to an aspect. The side wall 40 may include a window 42 having a see-through material 43 and a window flap 44 that is in a facing relationship with the window 42. According to an aspect, the window flap 44 is movable between an open position P3 and a closed position P4. FIGS. 10A and 11A illustrate the window flap 44 in the closed position P4, and FIGS. 10B-10C and 11B illustrate the window flap 44 in an open position.

In an embodiment, the side wall 40 includes a non-see-through portion 41 extending along and defining a lower portion 45 of the side wall 40. According to an aspect, the side wall 40 includes an upper portion 47 positioned between the lower portion 45 of the side wall 40 and the top panel 50. In an embodiment, the window 42 is disposed within the upper portion 47 of the side wall 40. According to an aspect, the window 42 comprises from about 65 to about 85 percent of a total area of the upper portion 47 of the side wall 40. The window 42 may include a see-through material 43 selected from the group consisting of a netting material, a screen material, a mesh material, a polymer film, and any combination thereof. In this configuration, the window 42 may provide ventilation to a user when the window flap 44 is open and/or moved away from the window 42. While the window flap 44 is illustrated as being secured at an end closest to the floor panel 60, and the free end being away from the top panel 50 towards the floor panel 60, it is envisioned that the window flap 44 may be secured at the end closest to the top panel 50. In any event, and as seen for instance, in FIG. 11B, when the window 42 is the see-through material, such as a mesh material, and the window flap 44 is in the open position P3, air may be admitted within the interior portion 22 of the enclosure 10. The window flap 44 may include a material selected from the group consisting of a see-through material, a non-see-through material, and any combination thereof. In an embodiment, the see-through material includes a polymer film. According to an aspect, the non-see-through material is selected from the group consisting of a woven fabric, a nonwoven fabric, a polymer film, and any combination thereof. In an embodiment, when the window flap 44 is the non-see-though material and the window flap 44 is in the closed position P4. According to an aspect, the window flap 44 may include at least one of a substantially solid material and a substantially waterproof material.

According to an aspect, at least a portion of at least one of the plurality of walls 20 includes an anti-fog coating configured to prevent condensation on the walls 20. Such anti-fog coating may minimize the surface tension of the walls 20 in a manner that does not allow beads of liquids, such as water, to form on the walls 20. The anti-fog coating may be a surfactant film or a solution that is wiped on and subsequently wiped off the walls 20. For example, the anti-fog coating may be applied to at least one of the entry wall 20, including the detachably fastened door flaps 32, and the windows 42 of the side walls 40, such that the user's line of sight is not compromised while the user is in the interior portion 22 of the enclosure 10 during rain, sleet, snow and the like.

Figure 12A:
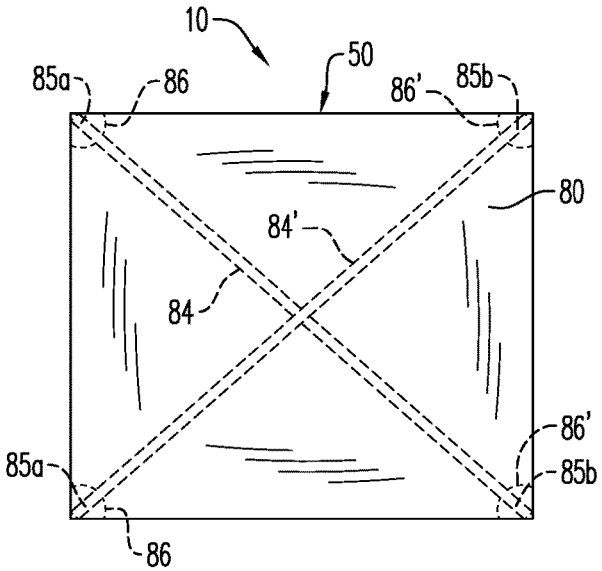
FIGS. 12A-12B are top down views of a canopy forming a top wall of a portable protective enclosure, according to an embodiment.
Figure 12B:
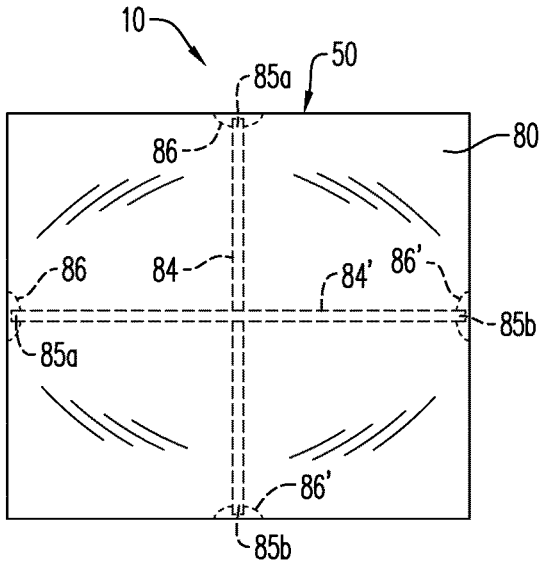
Figure 12C:
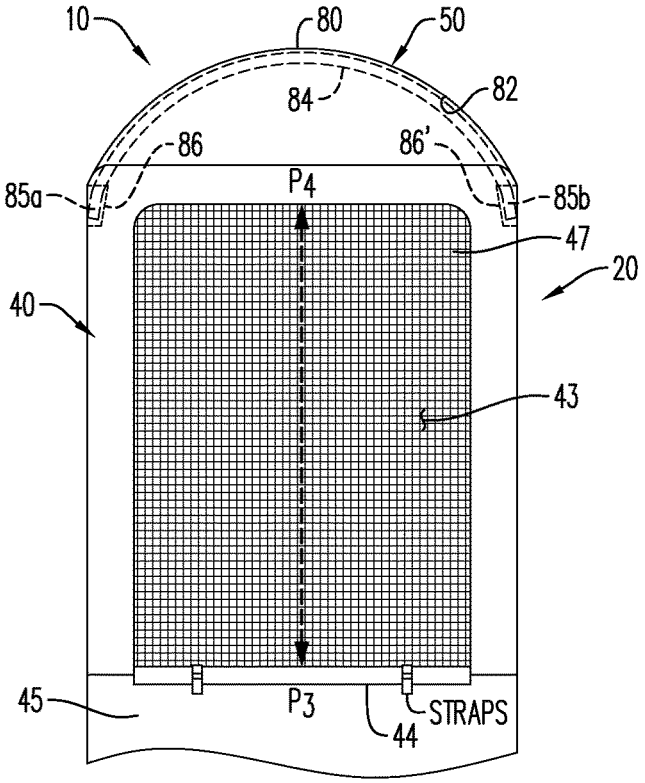
FIG. 12C is a side view of a portable protective enclosure, illustrating the canopy of FIGS. 12A-12B.
Figure 13A:
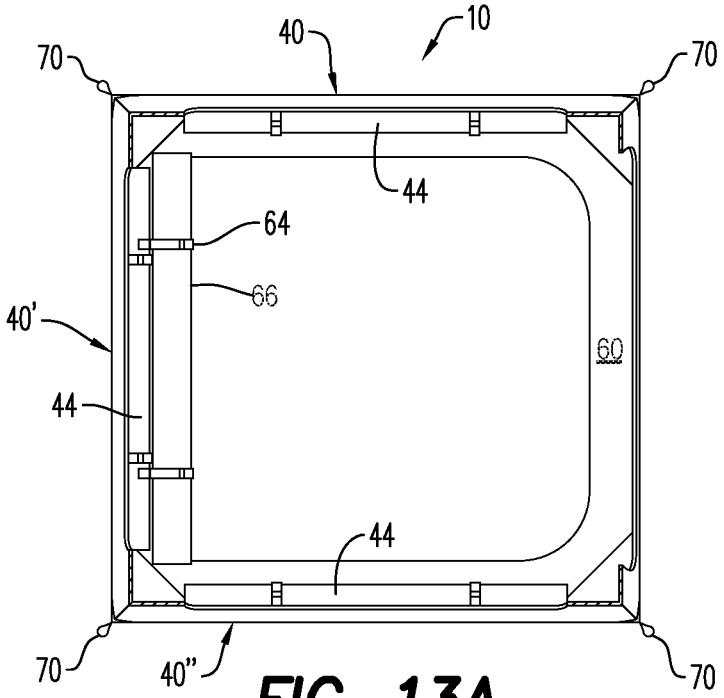
FIG. 13A is a bottom view of the portable protective enclosure of FIG. 1, illustrating the retractable floor portion, according to an embodiment.
Figure 13B:
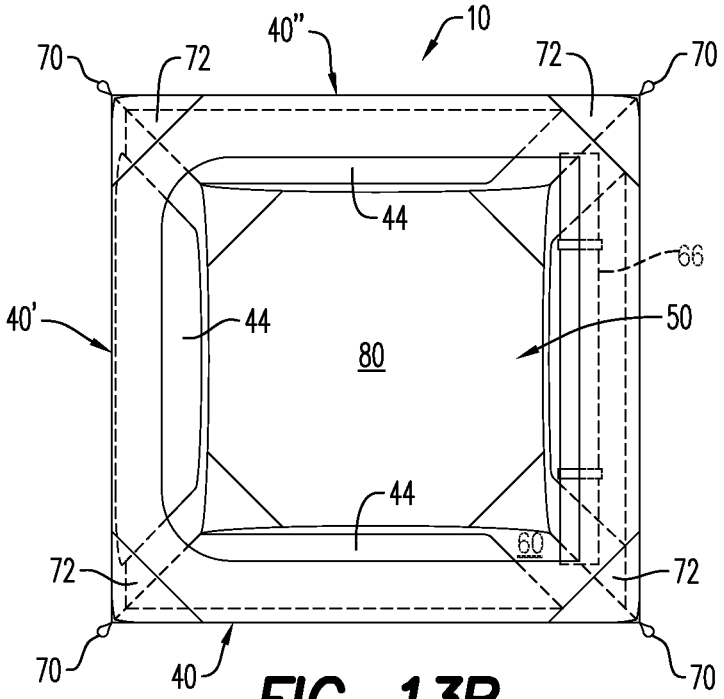
FIG. 13B is a schematic illustration of a floor portion of the portable protective enclosure of FIG. 1, according to an embodiment.
Figure 14A:
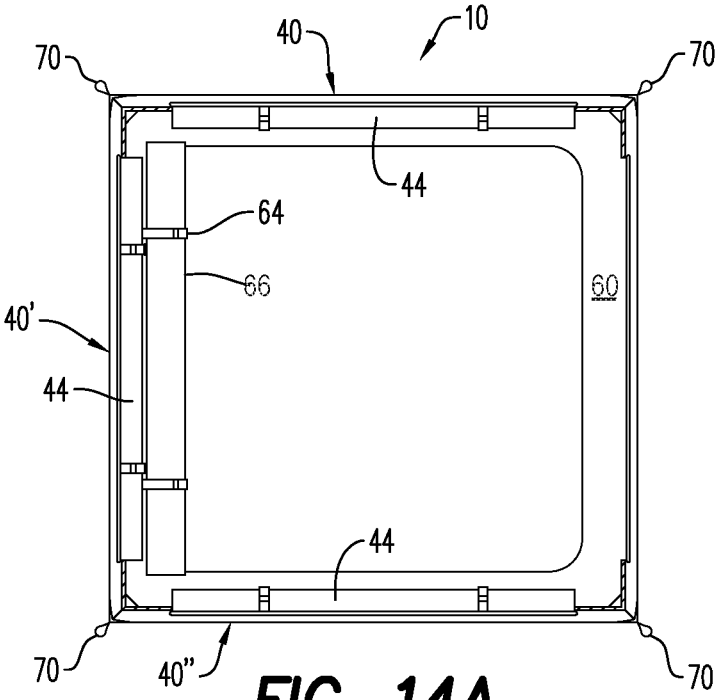
FIG. 14A is a bottom view of the portable protective enclosure of FIG. 2, illustrating the retractable floor portion and the windows in an open position, according to an embodiment.
Figure 14B:
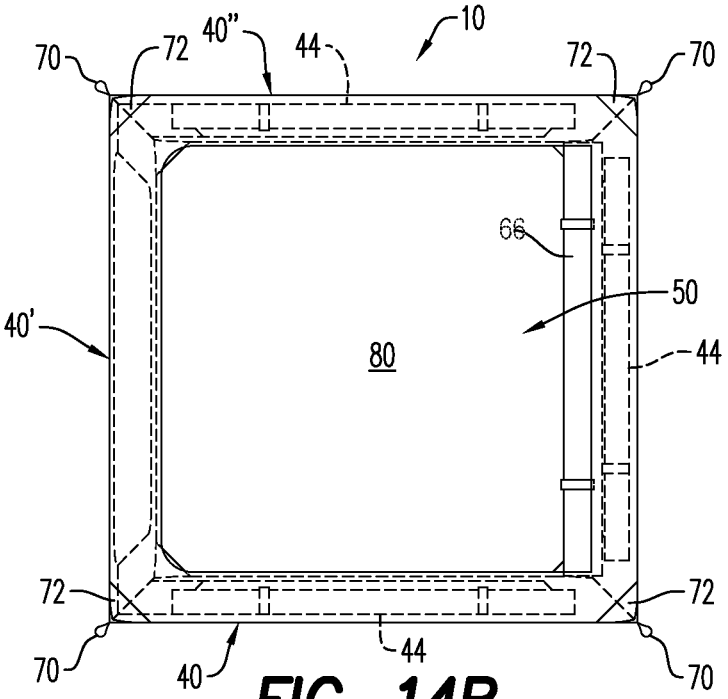
FIG. 14B is a schematic illustration of the floor portion of the portable protective enclosure of FIG. 2, according to an embodiment.
Figure 15A:
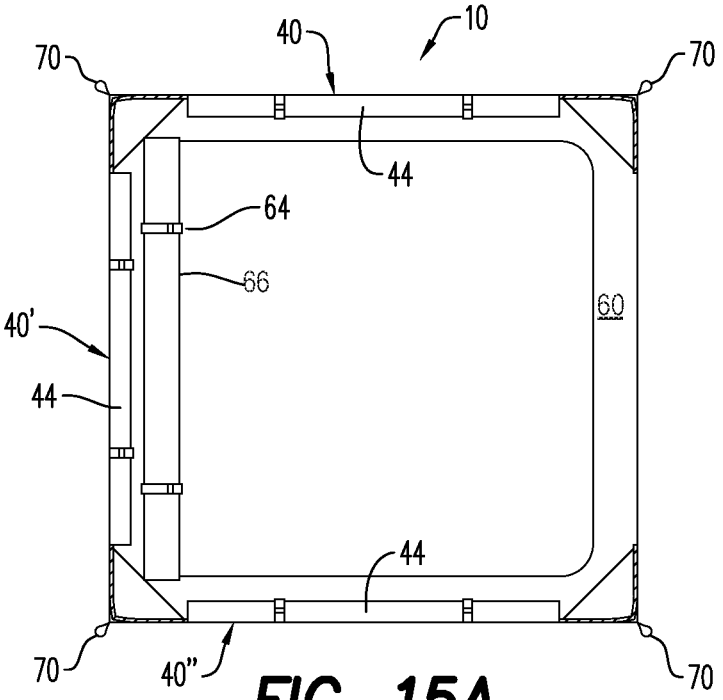
FIG. 15A is a bottom view of the portable protective enclosure of FIG. 3A, illustrating the retractable floor portion and the windows in an open position, according to an embodiment.
Figure 15B:
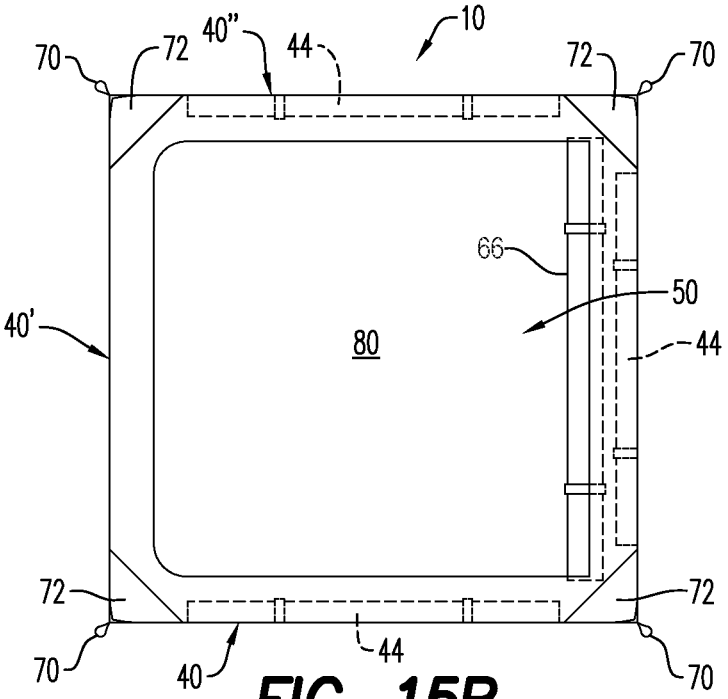
FIG. 15B is a schematic illustration of the floor portion of the portable protective enclosure of FIG. 3A, according to an embodiment.
Figure 16A:
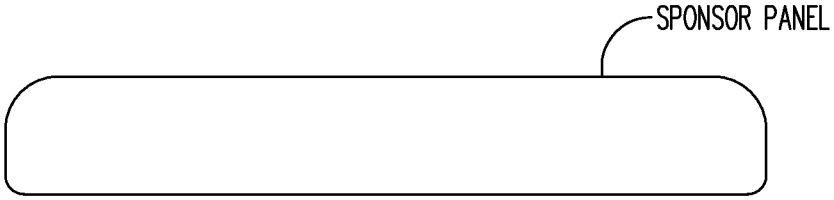
FIG. 16A is a top view of a sponsor panel of a portable protective enclosure, according to an embodiment.
Figure 16B:
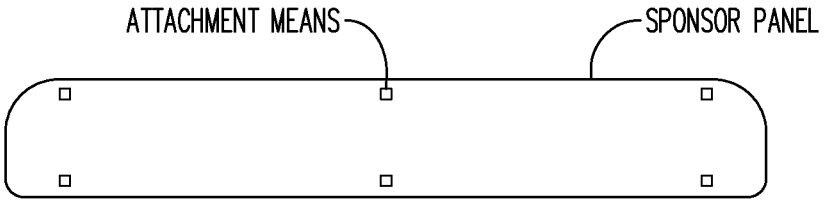
FIG. 16B is a bottom view of the sponsor panel of FIG. 16A.

According to an aspect, and as illustrated in FIGS. 12A-12C, the enclosure 10 includes the top panel 50. The top panel 50 may be arranged in a manner that allows it to overlay the interior space 22 of the portable protective enclosure 10. In an embodiment, the top panel 60 comprises the non-see-through material, which helps to provide shade to the user in the interior space 22 and/or prevent the entry to rain, snow, sleet, debris, insets, etc., within the interior space 22. The top panel 60 may include a thick/dense material that may prevent cold winds from entering the space 22. According to an aspect, the top panel 50 at least partially defines the interior space 22. The enclosure 10 may include a canopy 80 overlying the interior space 22. The canopy 80 may be held taut above the interior space 22 by way of a plurality of tension rods or flexible rods/poles 84 being arranged adjacent an underside 82 of the canopy 80 within the interior space 22. According to an aspect, the flexible rods 84 include a first rod end 85*a* and a second rod end 85*b*. Each of the first and second rod ends, 85*a*, 85*b* may be secured within the enclosure 10 by way of pockets 86 coupled to at least two of the plurality of walls 20. As seen for instance in FIGS. 12-12B, the first rod end 85*a* is secured in a first pocket 86 while the second rod end 85*b* is secured within an opposing pocket 86' arranged substantially across from the first pocket 86. According to an aspect, the pockets 86, 86' are secured to a part of the upper portion 47 of the side walls 40. In an embodiment, the canopy 80 is domed by virtue of the tension rods 84 being arranged to form a curved/elevated portion that lies above the interior space 22. In an embodiment, the flexible rods 84 include a resilient material that helps facilitate the canopy's 80 domed and/or raised configuration, and the canopy's overall ability to self deploy. This configuration may help to reduce the likelihood of water, snow, ice, etc., from pooling on the top panel 50 and/or the canopy 80.

According to an aspect, the enclosure 10 includes the floor panel 60. The floor panel 60 may include a partially removable floor flap 66. The floor flap 66 is detachably joined to the floor panel by a fastener 62. According to an aspect, the user of the portable protective enclosure 10 may access the fastener 62 from within the interior space 22. The user may detach and/or reattach the floor flap 66 from/to the floor panel. According to an aspect, the floor flap 66 can be at least partially detached from the floor panel 60 from within the interior space 22, so that the user has access to a groundcover 90 that is oriented below the floor panel 60. When in the partially detached condition, the floor flap 66 may be secured to a single side of the floor panel 60 by a retention device 64 such as a strap, ties, Velcro, or other temporary affixing device. The groundcover 90 on which the enclosure 10 is placed may be any surface that the user desires to position the portable protective enclosure 10 on, such as, for example, grass, synthetic turf, concrete, dirt, sand, stone, synthetic (e.g. rubber) or natural mulch, wood chips, engineered wood fiber, pavers, poured rubber, rubber tiles, wood decking, pea gravel, and the like.

Figure 6:
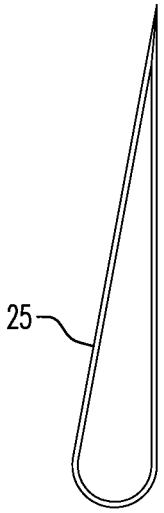
FIG. 6 is perspective view of a handle of a portable protective enclosure, according to an embodiment.

As illustrated in FIGS. 1-3A, 4B, 5A-5C, 10A-10C, the enclosure may include at least one handle 25 attached to an interior side 23 of the plurality of walls 20. As seen in FIG. 6, the handle 25 is configured as a strap/loop that has an open area for the user to place his or her hands, and secured ends that are affixed to at least one of the plurality of walls 20. In an embodiment, the handle 25 may be secured to the interior side 23 via stitch bonding, or any other method that may provide load bearing characteristics to the handle 25. According to an aspect, the handle 25 may provide mobility for a user without requiring the user to leave the interior space 22 of the enclosure 10. For instance, with the floor flap 66 in an at least partially detached condition, the handles 25 may be utilized for lifting the enclosure 10 from within the interior space 22. The user can also move the enclosure 10 from a first location to any additional locations, without having to leave the interior space 22. The handles 25, in combination with the retracted floor flap 66, may allow the user to move the enclosure 10 from within an interior space 22 of the enclosure, and thus change the user's location, which may be desirable in unfavorable weather conditions. For instance, when it is raining or snowing outside, the user can move the portable protective enclosure 10 from a wet area to a dry area, without having to be exposed to the weather elements, such as the rain/snow.

Figure 7:
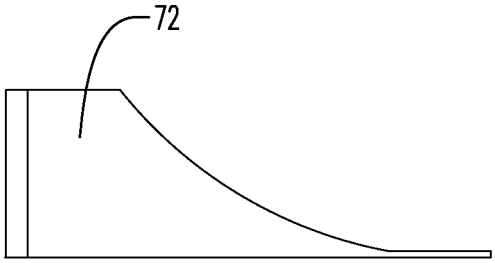
FIG. 7 is a side view of a weight of a portable protective enclosure, according to an embodiment.
Figure 8:
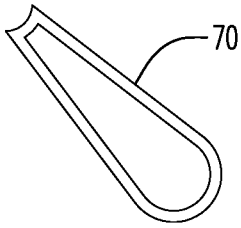
FIG. 8 is a side perspective view of an attachment member of a portable protective enclosure, according to an embodiment.
Figure 9:
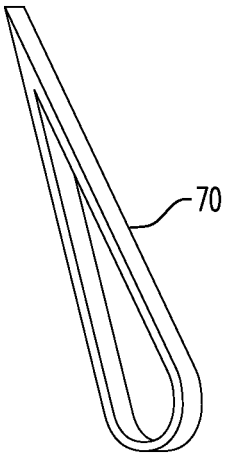
FIG. 9 is a side perspective view of yet another attachment member of a portable protective enclosure, according to an aspect.

The portable protective enclosure 10 may include a plurality of compartments 72 configured for maintaining the enclosure 10 in a desired position. According to an aspect and as illustrated in FIG. 7, the compartments 72 may be configured as pocket structures that allow for insertion of sand, rocks, sand bags, bean bags, and generally any substance capable of effectively anchoring the enclosure 10. As seen for instance in FIGS. 1-3A, 5A-5C and 10A-10C, the compartments 72 may be provided on the corners of the portable protective enclosure 10, closest to the groundcover 90. When weights are provided in compartments 72 positioned in all four corners, this may help to stabilize the enclosure 10 during windy or turbulent weather conditions.

According to an aspect and as illustrated in FIGS. 1, 3A, 5A-5C and 10A-10C, the portable protective enclosure 10 may also include a plurality of attachment members 70. The plurality of attachment members 70 may be configured as straps/loops that are secured at one or more ends of the enclosure 10. The plurality of attachment members 70 may be provided adjacent to and/or in place of the compartments 72, and may be positioned at one or more bottom corners 14 or top corners 12 of the portable protective enclosure 10. The plurality of attachment members 70 may secure the portable protective enclosure 10 to the groundcover 90 and help secure the enclosure 10 in the event of high wind or turbulent forces that may cause the enclosure to topple over. For instance, if the enclosure 10 is to be located on a grassy groundcover 90 surface, the attachment members 70 may receive tensioning members 74 such as a string, rope, strand, twine, cable, wire or even a guy-wire, which may be coupled to the attachment members 70 at one end and subsequently attached to an immobile structure, that is, structures that are at least semi-immobile and capable of ensuring the enclosure 10 remains where it was positioned, such as stakes or other at least semi-immobile structures, such as trees, park benches, and the like, to aid with securing the enclosure to the groundcover 90. According to an aspect, the attachment members 70 may be used with or without the plurality of compartments 72, and the compartments 72 can be used without the attachment members 70, for assisting with maintaining the portable protective enclosure 10 in a desired position.

According to an aspect and as found in FIGS. 13A-13B, 14A-14B, 15A-15B, the side wall 40 is the first side wall 40, and the plurality of walls 20 includes a second side wall 40' and a third side wall 40". In an embodiment, the second side wall 40' and the third side wall 40" each include a window 42 having a see-through material 43, and a window flap 44 for at least temporarily covering the window 42. The window 42 may include a see-through material selected from the group consisting of a netting material, a screen material, a mesh material, a transparent polymer film, a translucent polymer film, and any combination thereof. According to an aspect, the window flap 44 includes at least one of a substantially solid material and a substantially waterproof material.

The portable protective enclosure 10 described herein may include a sponsor panel on the non-see-through portions of the enclosure 10. The sponsor panel may include a removeable tab/label/pocket slip that is able to receive the logos or other indicia on the non-see-through portions. According to an aspect, the sponsor panel may be of the same size or less than the size of the non-see-through portion of one of the plurality of walls 20, and may be attached to the lower portion 26 of the walls 20. According to an aspect, the sponsor panel may be attached to at least one of the plurality of walls 20 directly under the top panel 50 and/or the canopy 80. It is envisioned that the logos or other indicia may be directly printed on a surface of the sponsor panel. In an embodiment, the sponsor panel includes a see-through pocket, within which the logos or other indicia may be provided. According to an aspect the sponsor panel includes a removeable/releasable tab that includes attachment members on a lower surface of the tab.

Figure 17:
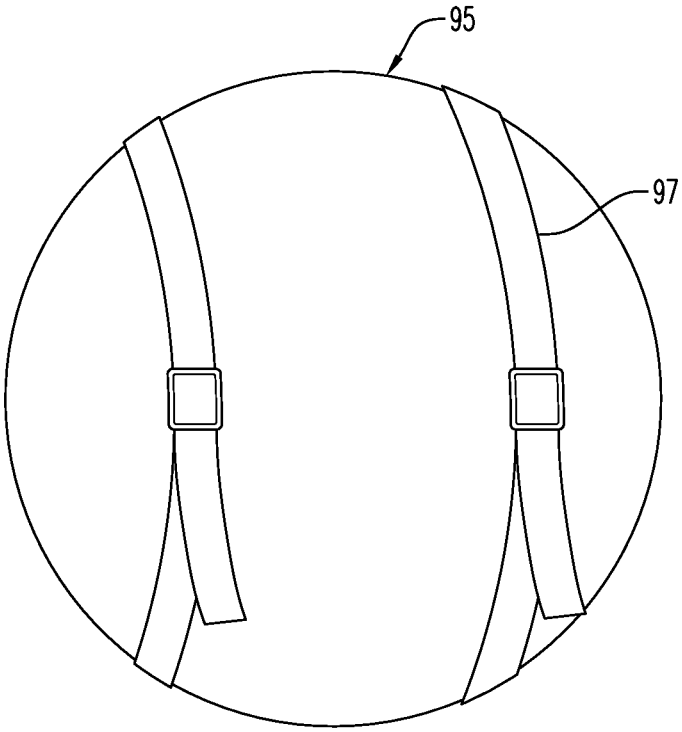
FIG. 17 is a perspective view of a carrier bag of a portable protective enclosure, according to an embodiment.

It is envisioned that the portable protective enclosure 10 may be a self-erecting and collapsible enclosure 10. According to an aspect, the enclosure 10 may be equipped with a flexible frame, as would be understood by one of ordinary skill in the art. (Not shown.) The flexible frame may help facilitate the self-erectability of the enclosure 10, such that the enclosure 10 may self deploy into a fully erected enclosure 10, with minimal effort by the user. In an embodiment, each of the plurality of walls 20, the canopy 80, the top panel 50 and the bottom panel 60 may be include a foldable material that helps to confine the flexible frame by way of stitching or other securing means. When the frame is in its fully expanded position, each of the plurality of walls 20, the canopy 80, the top panel 50 and the bottom panel 60 may be held taut, such that the portable protective enclosure 10 is in an upright, secure and fully-expanded position. The enclosure 10 may be sized to receive a single user as shown, for instance, in FIGS. 1, 5A, and 10A. In some embodiments, the enclosure 10 may be sized to receive 2, 3 4, or more users, as seen for instance in FIGS. 2-3, 5B-5C, and 10B-10C. According to an aspect, the enclosure may be sized and dimensioned such to receive a standing person (see, for instance, FIGS. 1-3), a seated person and a chair (see, for instance, FIGS. 1-3), and a group of people or team of persons, and a picnic table (see, for instance, FIGS. 2-3). According to an aspect, the enclosure 10 may be collapsed in such a manner that the entire enclosure 10 is flat and compact, and insertable within a carrier bag 95. (See for instance, FIG. 17.) The carrier bag 95 may include straps 97 that enable the user to transport the portable protective enclosure 10 from one location to another desired location. As shown herein, the straps 97 are arranged as a backpack.

The embodiments of the disclosure may be associated with a method of using the portable protective enclosures 10, substantially as described hereinabove. For instance, a method 200 of using the portable protective enclosure may include, from within the interior space, detaching 220 the floor flap from the floor panel 60, grasping 240 the pair of handles, lifting 260 the portable protective enclosure, and moving 280 the portable protective enclosure 10 to a desired location. The portable protective enclosure thus provides the user with mobility that does not require the user to leave the enclosure.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A self-erecting portable protective enclosure comprising:

a canopy portion;

a floor portion spaced apart from the canopy portion, and comprising an at least partially removable floor flap;

a plurality of walls extending between the canopy portion and the floor portion, the walls comprising:

a back wall, an entry wall spaced apart from the back wall and comprising a fully detachable door flap, wherein the door flap comprises a viewing window formed in an upper portion of the door flap, a plurality of side walls extending between the back wall and the entry wall, each side wall comprising a multilayered window comprising a see-through material and a window flap in a facing relationship with the see-through material, wherein the window flap is accessible to a user within an interior space of the enclosure and moves between open and closed positions; and at least one handle extending from an inner surface of the side walls, the handle being configured for receiving a hand of the user to facilitate the user moving the enclosure from a first location to a second location while the user is within the interior space, wherein each of the canopy portion, the floor portion, and the plurality of walls comprises a foldable material, wherein the foldable material is secured to a flexible frame such that the enclosure is configured to self-erect into a fully expanded enclosure and collapse into a substantially flat enclosure.

2. The enclosure of claim 1, wherein the foldable material comprises at least one of a substantially solid material, a water-resistant material and a waterproof material.

3. The enclosure of claim 1, wherein at least one of the see-through material and the window flap of the multilayered window is formed from a material comprising at least one of a netting material, a screen material, a mesh material, a polymer, and a polymer film, and the see-through material comprises a different material than the window flap.

4. The enclosure of claim 3, wherein the see-through material comprises about 65 percent to about 85 percent of a total area of each of the side walls.

5. The enclosure of claim 3, wherein the window flap is configured for temporarily covering the window and preventing admittance of weather elements within the interior space.

6. The enclosure of claim 1, wherein for each of the side walls, the see-through material comprises a mesh material and the window flap comprises a plastic material, such that the multilayered window provides ventilation to the user when the window flap is in the open position.

7. The enclosure of claim 1, wherein the plurality of walls each comprise a non-see-through wall portion extending along and defining a lower portion of the plurality of walls.

8. The enclosure of claim 7, wherein the non-see-through material comprises a material formed from one of a woven fabric, a nonwoven fabric, a polymer film, and any combinations thereof.

9. The enclosure of claim 1, wherein the door flap comprises a plurality of layered door flaps, wherein a first door flap comprises a material selected from the group consisting of a netting material, a screen material, a mesh material and a polymer film; and a second door flap comprises a material selected from the group consisting of a substantially solid material, a water-resistant material and a waterproof material.

10. The enclosure of claim 1, further comprising:

a plurality of compartments extending from the walls, adjacent the floor portion, wherein the compartments are configured for receiving weights to secure the enclosure to the first location and the second location.

11. A self-erecting portable protective enclosure comprising:

a canopy portion;

a floor portion spaced apart from the canopy portion, and comprising an at least partially removable floor flap;

a plurality of walls extending between the canopy portion and the floor portion, the walls comprising:

a back wall, an entry wall spaced apart from the back wall and comprising a fully detachable door flap, wherein the door flap comprises a viewing window formed in an upper portion of the door flap, two side walls extending between the back wall and the entry wall, each side wall comprising a multilayered window comprising a see-through material and a window flap in a facing relationship with the see-through material, wherein the window flap is accessible to a user within an interior space of the enclosure and moves between open and closed positions;

a plurality of handles extending from an inner surface of the side walls, each of the handles being configured for receiving a hand of the user to facilitate the user moving the enclosure from a first location to a second location while the user is within the interior space; and a flexible frame configured to self-erect the enclosure into a fully expanded enclosure and collapse into a substantially flat enclosure.

12. The enclosure of claim 11, wherein at least one of the see-through material and the window flap of the multilayered window is formed from a material comprising at least one of a netting material, a screen material, a mesh material, a polymer, and a polymer film, and the see-through material comprises a different material than the window flap.

13. The enclosure of claim 12, wherein the see-through material comprises about 65 percent to about 85 percent of a total area of each of the side walls.

14. The enclosure of claim 12, wherein the window flap is configured for temporarily covering the window and preventing admittance of weather elements within the interior space.

15. The enclosure of claim 11, wherein for each of the side walls, the see-through material comprises a mesh material and the window flap comprises a plastic material, such that the multilayered window provides ventilation to the user when the window flap is in the open position.

16. The enclosure of claim 11, wherein the plurality of walls each comprise a non-see-through wall portion extending along and defining a lower portion of the plurality of walls.

17. The enclosure of claim 16, wherein the non-see-through material comprises a material formed from one of a woven fabric, a nonwoven fabric, a polymer film, and any combinations thereof.

18. The enclosure of claim 11, wherein the door flap comprises a plurality of layered door flaps, wherein a first door flap comprises a material selected from the group consisting of a netting material, a screen material, a mesh material and a polymer film; and a second door flap comprises a material selected from the group consisting of a substantially solid material, a water-resistant material and a waterproof material.

19. The enclosure of claim 11, further comprising:

a plurality of compartments extending from the walls, adjacent the floor portion, wherein the compartments are configured for receiving weights to secure the enclosure to the first location and the second location.

20. The enclosure of claim 11, wherein at least a portion of at least one of the entry wall, the back wall and the two side walls comprise an anti-fog coating to prevent condensation on the walls.

* * * * *